US009511473B2

(12) United States Patent
Biller

(10) Patent No.: US 9,511,473 B2
(45) Date of Patent: Dec. 6, 2016

(54) HOSE END CLEAN-UP FIXTURE

(71) Applicant: Eaton Corporation, Cleveland, OH (US)

(72) Inventor: Brandon Dennis Biller, Ferndale, MI (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/914,394

(22) PCT Filed: Aug. 28, 2014

(86) PCT No.: PCT/US2014/053084
§ 371 (c)(1),
(2) Date: Feb. 25, 2016

(87) PCT Pub. No.: WO2015/031575
PCT Pub. Date: Mar. 5, 2015

(65) Prior Publication Data

US 2016/0207164 A1 Jul. 21, 2016

Related U.S. Application Data

(60) Provisional application No. 61/872,274, filed on Aug. 30, 2013.

(51) Int. Cl.
*B24B 19/00* (2006.01)
*B24B 1/00* (2006.01)
*B24B 41/06* (2012.01)

(52) U.S. Cl.
CPC ..... *B24B 41/06* (2013.01); *B24B 1/00* (2013.01); *B24B 19/00* (2013.01)

(58) Field of Classification Search
CPC ..... B24B 41/06; B24B 1/00; B24B 19/00; B24B 33/02; B24B 5/40; B24B 19/02
See application file for complete search history.

(56) References Cited

U.S. PATENT DOCUMENTS 5,400,546 A * 3/1995 Christian ..... B24B 3/32 451/138
5,447,464 A * 9/1995 Franklin ..... B24B 19/226 451/28

(Continued)

FOREIGN PATENT DOCUMENTS

JP 62-015069 A 1/1987
JP 01-216757 A 8/1989
JP 03-032559 A 2/1991

OTHER PUBLICATIONS

Written Opinion of the International Searching Authority for PCT/US2014/053084 dated Nov. 25, 2014.

(Continued)

*Primary Examiner* — Dung Van Nguyen
(74) *Attorney, Agent, or Firm* — Jarett D. Millar

(57) ABSTRACT

A grinding fixture assembly for use in grinding an end surface of a hose includes a housing, a bearing assembly disposed in the housing, and an insert assembly. The bearing assembly defines a central bore. The insert assembly is disposed in the central bore of the bearing assembly. The insert assembly includes an insert housing, an adapter and a bearing. The insert housing defines a thru-hole that extends through the insert housing. The thru-hole is disposed at an oblique angle in the insert housing. The adapter is disposed in the thru-hole of the insert housing. The adapter defines a bore that is adapted to receive an end portion of a hose. The bearing is disposed between the insert housing and the adapter. The bearing allows for rotation of the insert housing while the adapter is maintained rotationally stationary.

20 Claims, 10 Drawing Sheets

(56) References Cited

U.S. PATENT DOCUMENTS

| | | | | |
|---|---|---|---|---|
| 5,931,726 | A * | 8/1999 | Peters | B24B 21/002 451/296 |
| 6,244,938 | B1 * | 6/2001 | Ploeger | B23B 51/02 451/375 |
| 6,652,367 | B1 * | 11/2003 | Lin | B24B 3/24 451/178 |
| 6,676,494 | B1 * | 1/2004 | Ching | B24B 3/247 451/231 |
| 7,641,202 | B1 * | 1/2010 | Dovel | B23B 31/1215 269/233 |

OTHER PUBLICATIONS

International Search Report for PCT/US2014/053084 dated Nov. 25, 2014.

* cited by examiner

HOSE END CLEAN-UP FIXTURE

CROSS-REFERENCE TO RELATED APPLICATIONS

This application is being filed on Aug. 28, 2014, as a PCT International Patent application and claims priority to U.S. Patent Application Ser. No. 61/872,274 filed on Aug. 30, 2013, the disclosure of which is incorporated herein by reference in its entirety.

BACKGROUND

High pressure reinforced hydraulic hose is typically used on a variety of fluid power operated machines, such as earth-moving machines, to provide a flexible connection between several moving parts of a hydraulic circuit employed on or within the machine. Such hoses may include a hollow polymeric inner tube on which successive cylindrical layers of reinforcing material, such as wire or textile, are concentrically applied to contain the radial and axial pressures developed within the inner tube.

In some circumstances, it is desirable to detect, in a non-destructive and non-disruptive manner a likelihood of failure of a hydraulic hose. One solution providing this capability is discussed in U.S. Pat. No. 7,555,936, which discloses connecting a monitor circuit between two parallel, at least partially-conductive layers of a hose wall. A change in an electrical property observed by that monitor circuit may indicate a change in a property of the hose wall structure that might indicate impending failure of the hose wall.

During the manufacturing process for the hose, the length of the hose is cut to a desired length. In some instances, the cutting operation results in the conductive layers contacting each other at the cut location. As a result, the electrical property observed by the monitoring circuit is inaccurate.

SUMMARY

An aspect of the present disclosure relates to a grinding fixture assembly for use in grinding an end surface of a hose. The grinding fixture includes a housing, a bearing assembly disposed in the housing, and an insert assembly. The bearing assembly defines a central bore. The insert assembly is disposed in the central bore of the bearing assembly. The insert assembly includes an insert housing, an adapter and a bearing. The insert housing defines a thru-hole that extends through the insert housing. The thru-hole is disposed at an oblique angle in the insert housing. The adapter is disposed in the thru-hole of the insert housing. The adapter defines a bore that is adapted to receive an end portion of a hose. The bearing is disposed between the insert housing and the adapter. The bearing allows for rotation of the insert housing while the adapter is maintained rotationally stationary.

Another aspect of the present disclosure relates to a grinding fixture assembly for use in grinding a surface of a part. The grinding fixture includes a housing, a bearing assembly disposed in the housing, and an insert assembly. The bearing assembly defines a central bore. The insert assembly is disposed in the central bore of the bearing assembly. The insert assembly includes an insert housing, an adapter and a bearing. The insert housing defines a central longitudinal axis and a thru-hole that extends through the insert housing. The thru-hole is disposed at an oblique angle to the central longitudinal axis of the insert housing. The adapter is disposed in the thru-hole of the insert housing. The adapter defines a bore that is adapted to receive a portion of a hose. The bearing is disposed between the insert housing and the adapter. The bearing allows for rotation of the insert housing while the adapter is maintained rotationally stationary so that the surface of the part orbits about the central longitudinal axis.

Another aspect of the present disclosure relates to a method for grinding an end surface of a hose. The method includes inserting an end portion of a hose into a bore of an adapter of a grinding fixture. The adapter is disposed in a thru-hole of an insert housing with a bearing disposed between the insert housing and the adapter. The thru-hole is disposed at an oblique angle relative to a central longitudinal axis of the insert housing. The insert housing is rotated so that an end surface of the hose orbits about the central longitudinal axis of the insert housing while the end surface of the hose remains rotationally stationary about a central longitudinal axis of the hose.

DRAWINGS

FIGS. 10*a*-10*e* is a front view of a grinder showing the orbital movement of an end surface of a hose disposed in the grinding fixture during operation of the grinding fixture.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
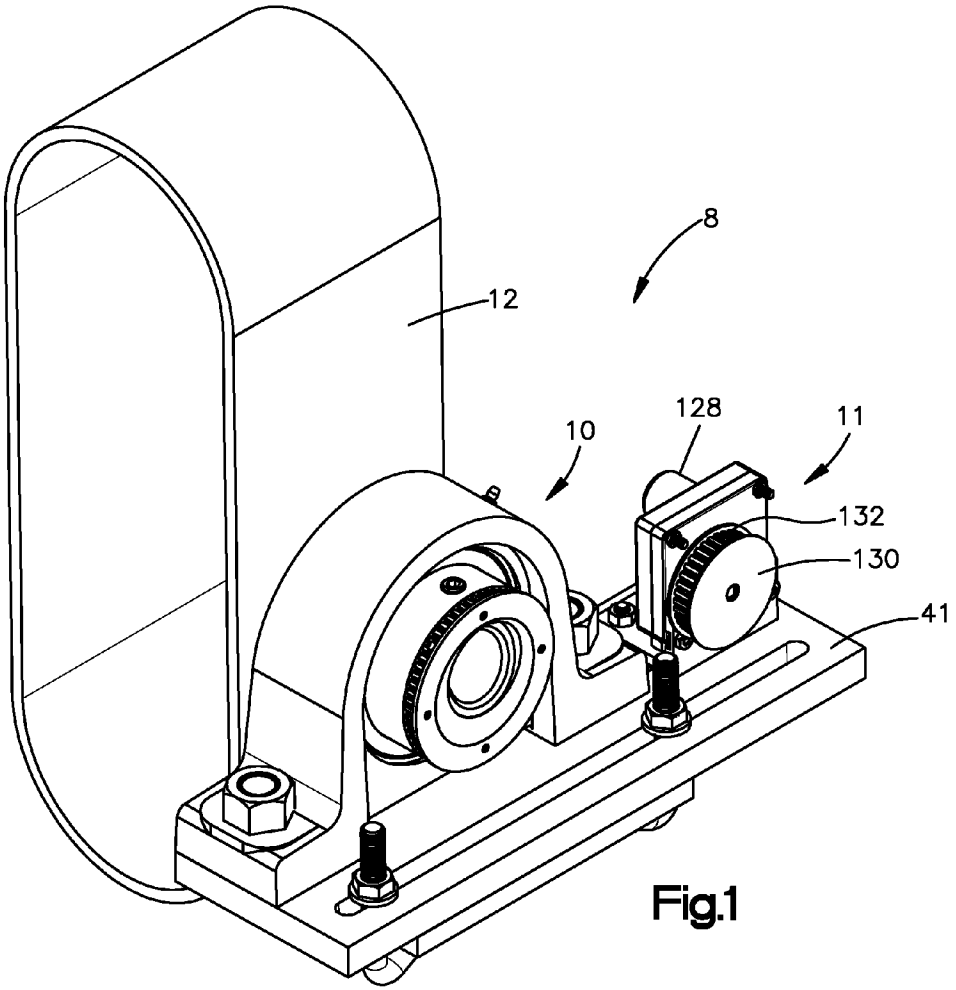
FIG. 1 is an isometric view of a grinding fixture assembly having exemplary features of aspects in accordance with the principles of the present disclosure.
Figure 2:
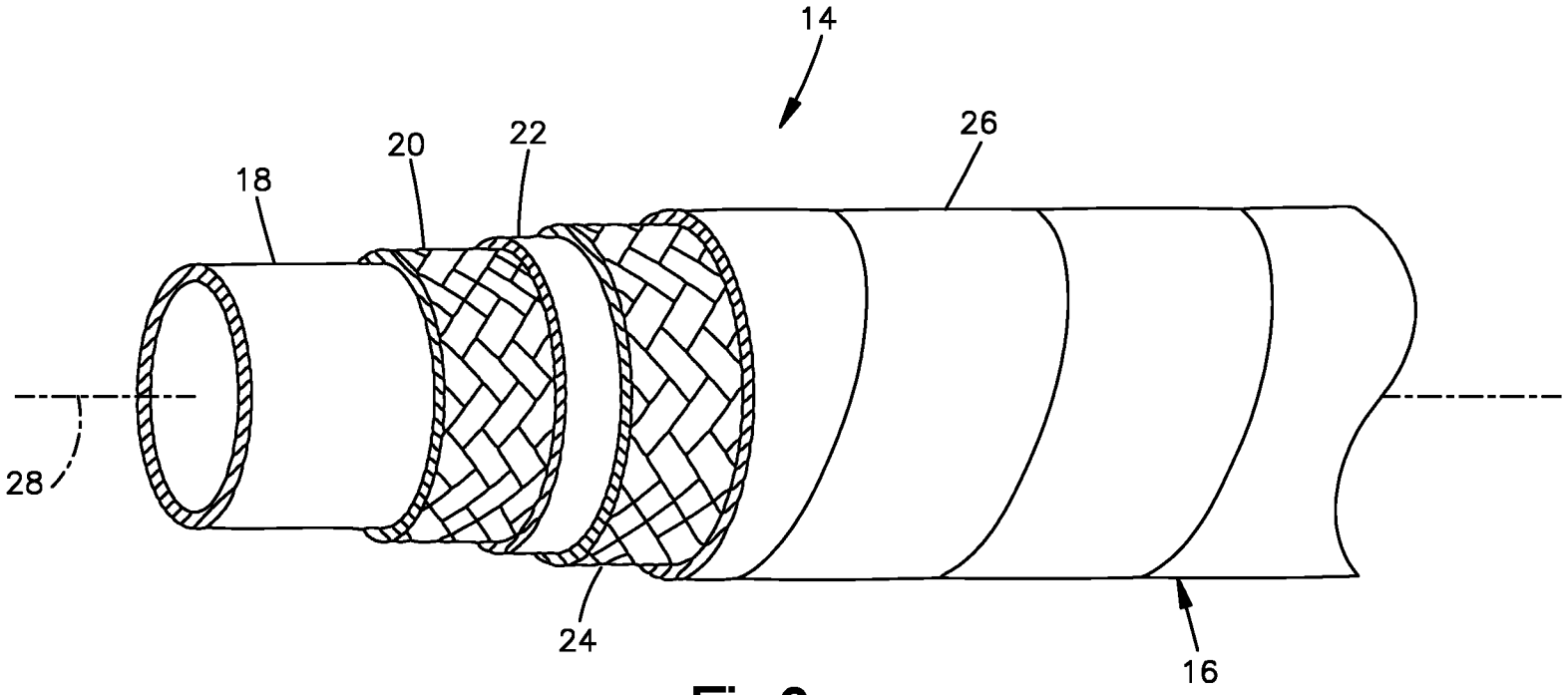
FIG. 2 is an isometric view, partially cut away, of a hose suitable for use with the grinding fixture of FIG. 1.

Referring now to FIGS. 1 and 2, a grinding fixture assembly 8 is shown. In the depicted embodiment, the grinding fixture assembly 8 includes a grinding fixture 10 and a motor assembly 11. The grinding fixture assembly 8 is adapted for disposition adjacent to a grinder 12. In the depicted embodiment, the grinder 12 is shown as a belt sander. The grinding fixture assembly 8 is adapted to receive an end portion 14 of a hose 16 and to allow a chamfer to be ground around the end portion 14 of the hose 16 without rotating the hose 16 about its longitudinal axis.

Referring now to FIG. 2, the hose 16 is shown. In the depicted embodiment, the hose 16 is a multi-layer construction that includes an inner tube 18, a first conductive layer 20, an intermediate layer 22, a second conductive layer 24 and an outer cover 26. The hose 16 may include a reinforcing layer. In one embodiment, the first and second layers 20, 24 may be configured as reinforcing layers. In another embodiment, reinforcing material may be disposed in one of the layers of the hose 16 (e.g, outer cover 26, etc.).

The first conductive layer 20 overlays the inner tube 18 and the intermediate layer 22 overlays the first conductive layer 20. The second conductive layer 24 overlays the intermediate layer 22. The outer layer 26 overlays the second conductive layer 24.

The first and second conductive layers 20, 24 define an electrical characteristic of the hose 16, such as capacitance, inductance and/or resistance (impedance). The first and second conductive layers 20, 24 are made of an electrically conductive material. In the depicted embodiment, the first and second conductive layers 20, 24 are made of an electrically conductive braided reinforcement material.

The intermediate layer 22 operates to at least partially electrically insulate the first and second conductive layers 20, 24 from one another. The intermediate layer 22 may have any of a variety of constructions. For example, the intermediate layer 22 may consist of a single layer of an electrically resistive material. The intermediate layer 22 may also consist of multiple layers, wherein at least one of the layers exhibits electrical insulating properties.

During manufacturing of the hose 16, the hose 16 is cut to a desired length that is based on a requested length of an end user. The hose 16 is cut in a direction that is generally perpendicular to a longitudinal axis 28 of the hose 16. In response to the cutting operation, the first and second conductive layers 20, 24 may make contact with each other at the location of the cut. If the first and second conductive layers 20, 24 make contact with each other at the location of the cut, the hose 16 will not function as intended as the first and second conductive layers 20, 24 will not accurately define the electrical characteristic. Therefore, a clean-up operation is performed at the location of the cut on the hose 16 to ensure the first and second conductive layers 20, 24 are not contacting each other.

Figure 3:
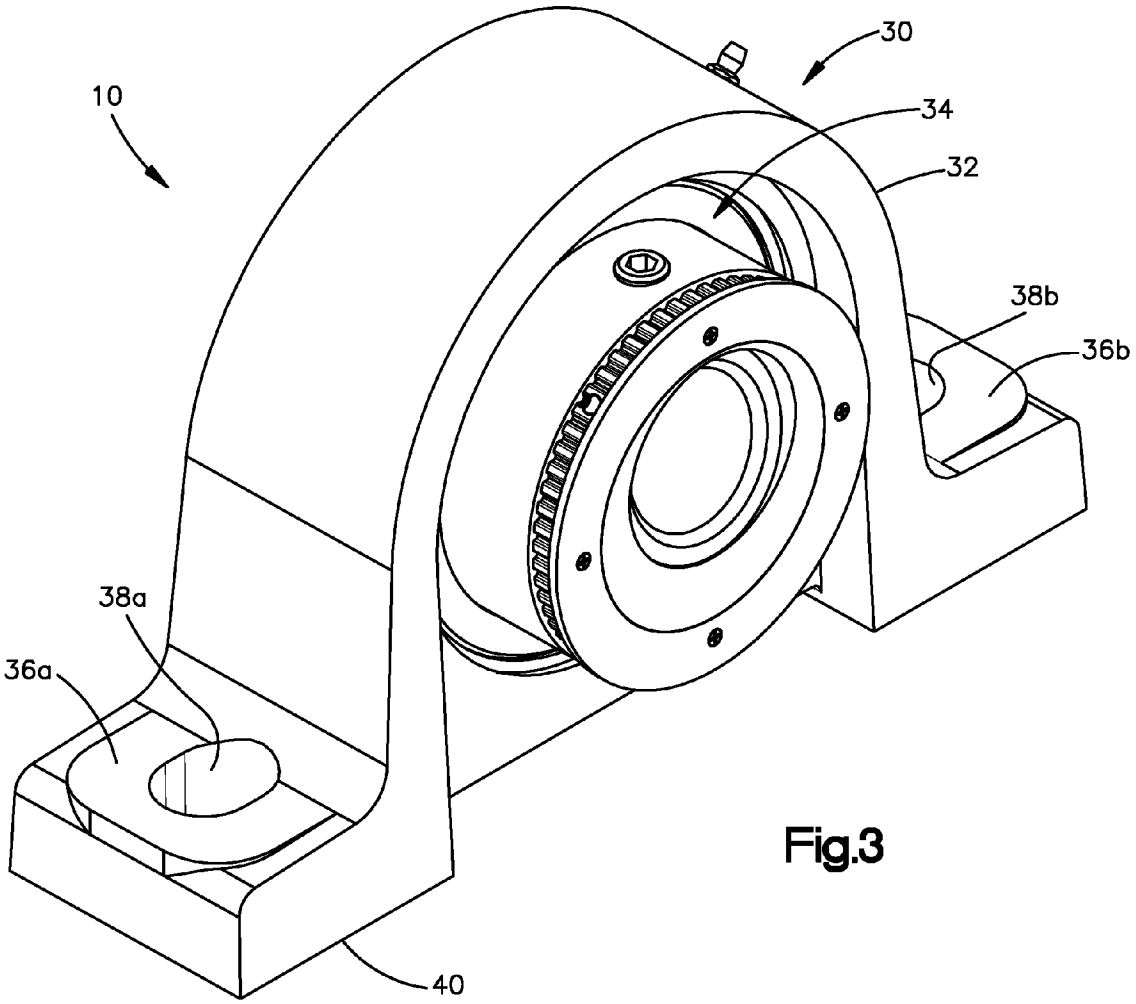
FIG. 3 is an isometric view of a grinding fixture suitable for use with the grinding fixture assembly of FIG. 1.
Figure 4:
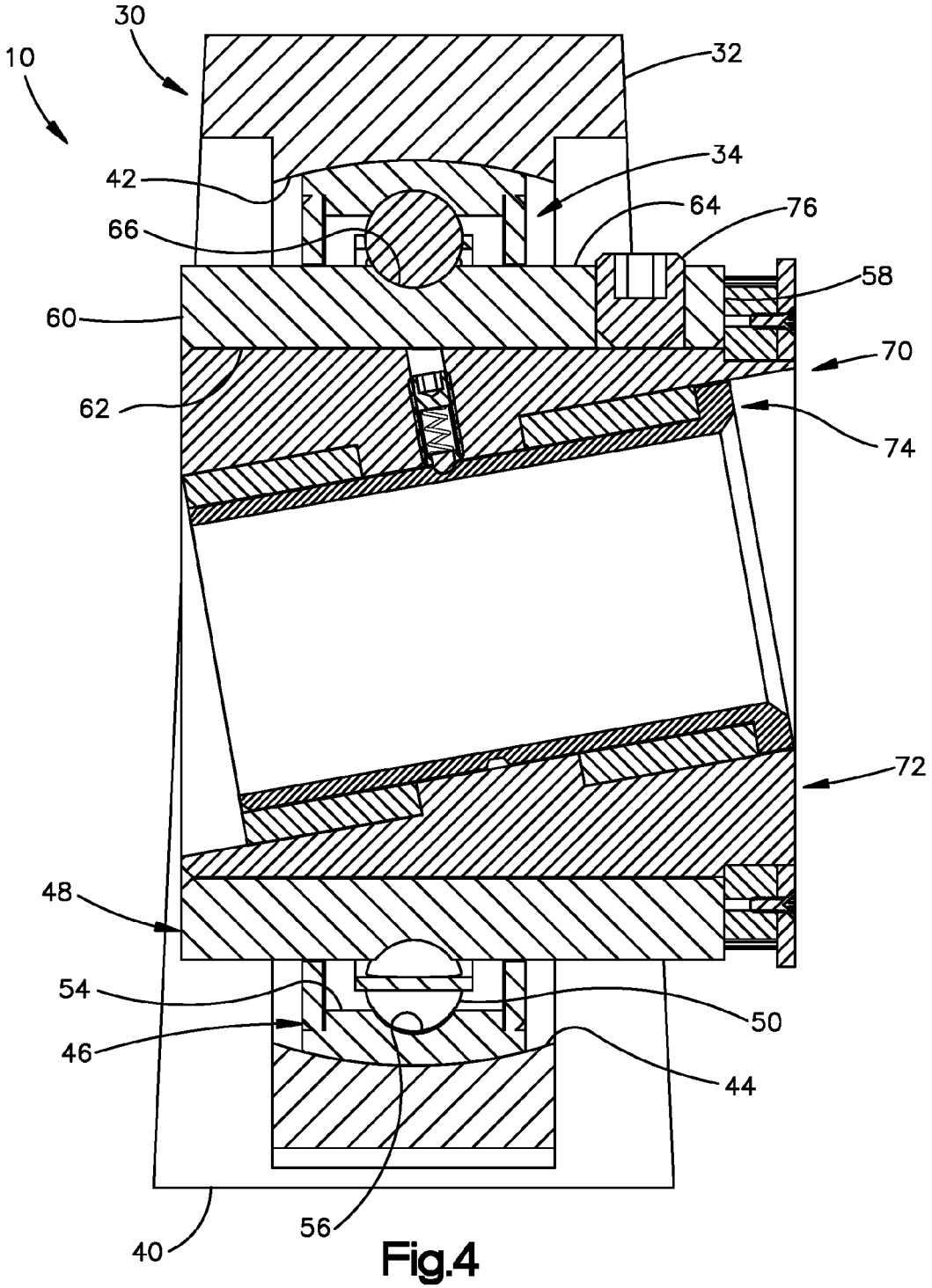
FIG. 4 is a cross-sectional view of the grinding fixture of FIG. 3.

Referring now to FIGS. 1, 3 and 4, the grinding fixture 10 will be described. The grinding fixture 10 includes a housing assembly 30. In the depicted embodiment, the housing assembly 30 is a conventional pillow block. The housing assembly 30 includes a body 32 and a bearing assembly 34.

In the depicted embodiment, the body 32 includes a first flange 36*a* that extends outwardly from the body 32 in a first direction and a second flange 36*b* that extends outwardly from the body 32 in a second direction that is opposite the first direction. The first flange 36*a* defines a first mounting hole 38*a* while the second flange 36*b* defines a second mounting hole 38*b*. The first and second flanges 36*a*, 36*b* cooperatively define a mounting surface 40. In the depicted embodiment, the mounting surface 40 is a planar surface that is adapted for mounting to a mounting plate 41 of the grinder 12.

The body 32 includes an inner surface 42. The inner surface 42 defines a central opening 44.

The bearing assembly 34 is disposed in the central opening 44 of the body 32. The bearing assembly 34 includes an outer bearing race 46, an inner bearing race 48 and a plurality of bearings 50 disposed between the outer and inner bearing races 46, 48. In the depicted embodiment, the bearings 50 are ball bearings.

The outer bearing race 46 is disposed in the central opening 44 of the body 32. The outer bearing race 46 includes an inner surface 54 defining an inner circumferential groove 56.

The inner bearing race 46 is adapted to rotate within the central opening 44 of the body 32. In the depicted embodiment, the inner bearing race 46 is generally cylindrical in shape. The inner bearing race 46 includes a first axial end 58 and an oppositely disposed second axial end 60. The inner bearing race 46 defines a central bore 62 that extends through the first and second ends 58, 60. The inner bearing race 46 includes an outer surface 64 that defines a circumferential groove 66 disposed between the first and second axial ends 58, 60.

Figure 5:
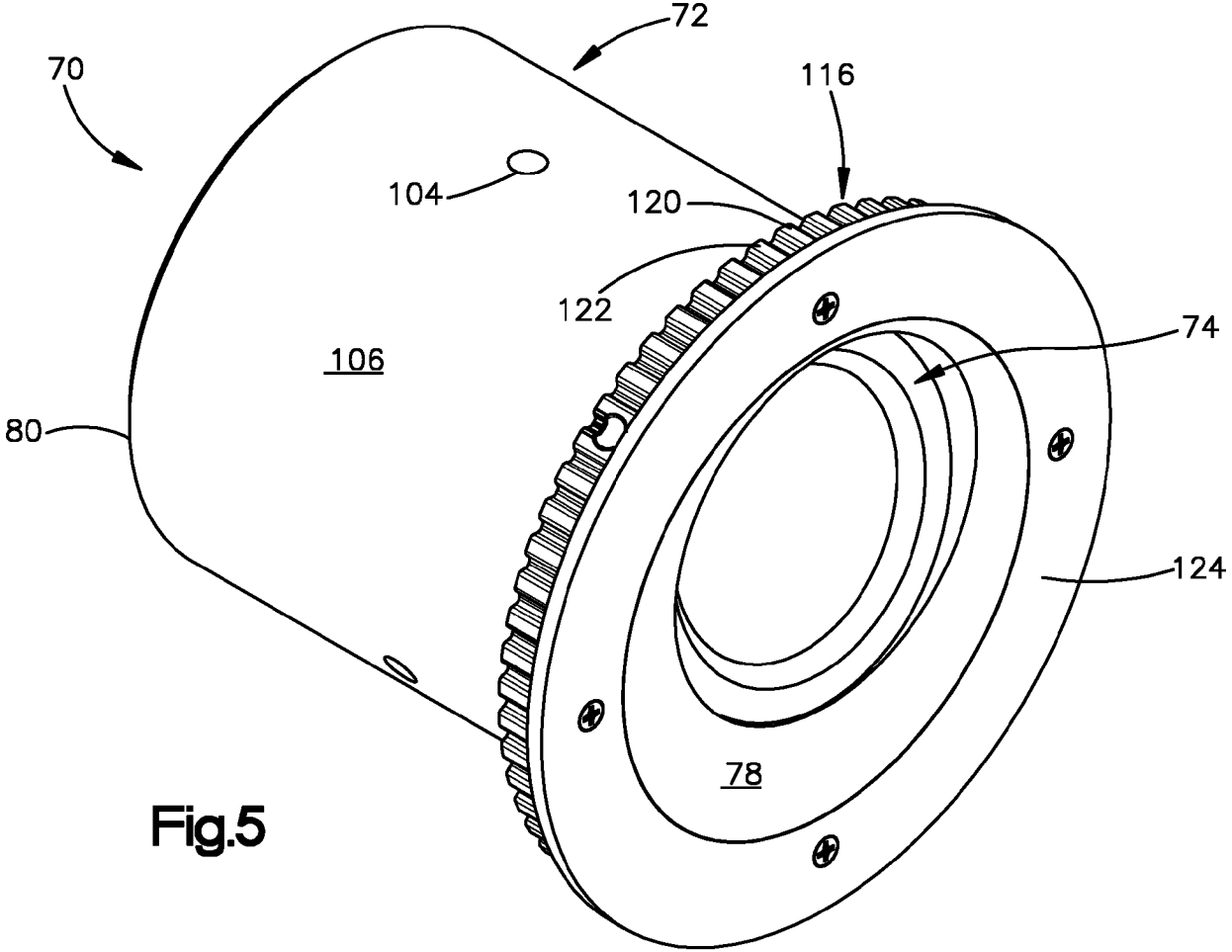
FIG. 5 is an isometric view of an insert assembly suitable for use with the grinding fixture of FIG. 3.
Figure 6:
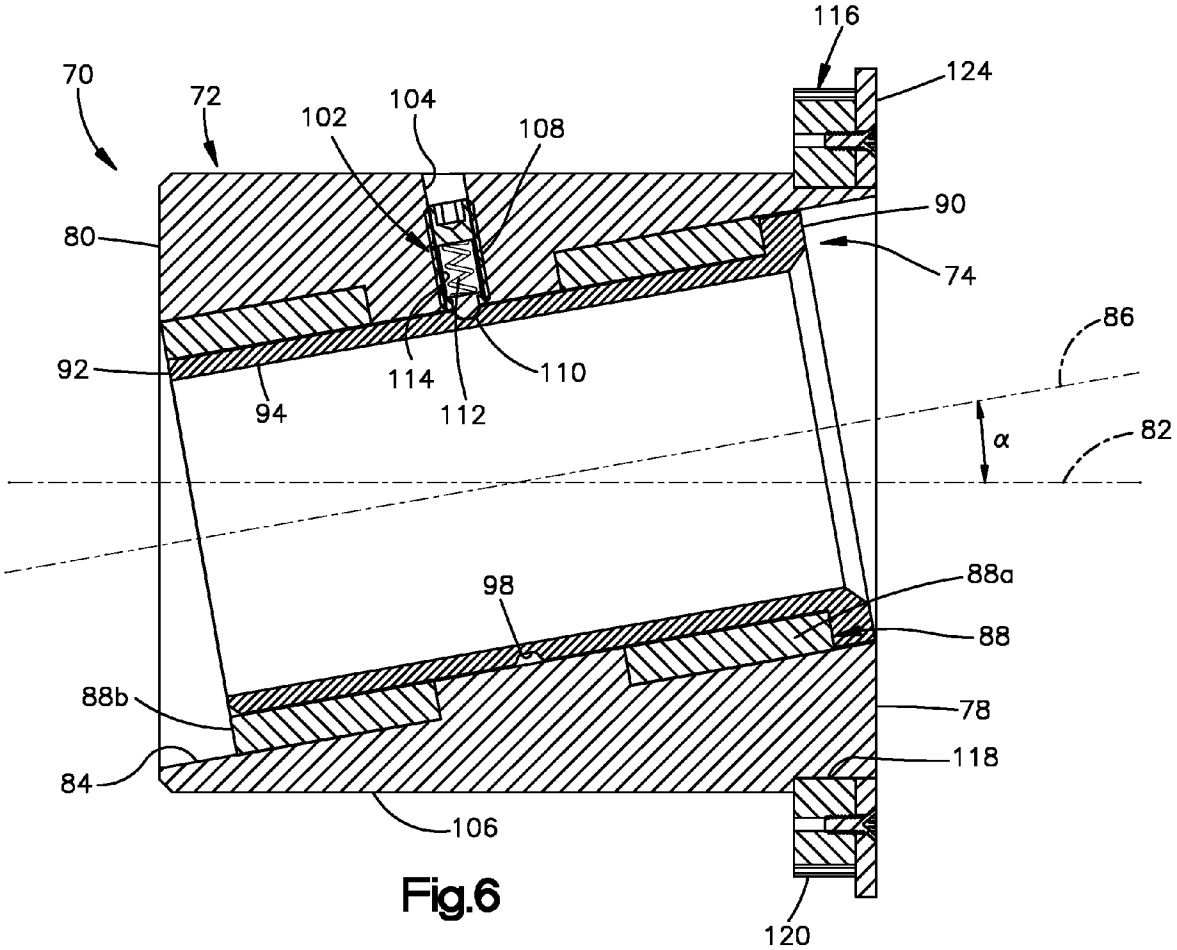
FIG. 6 is a cross-sectional view of the insert assembly of FIG. 5.
Figure 7:
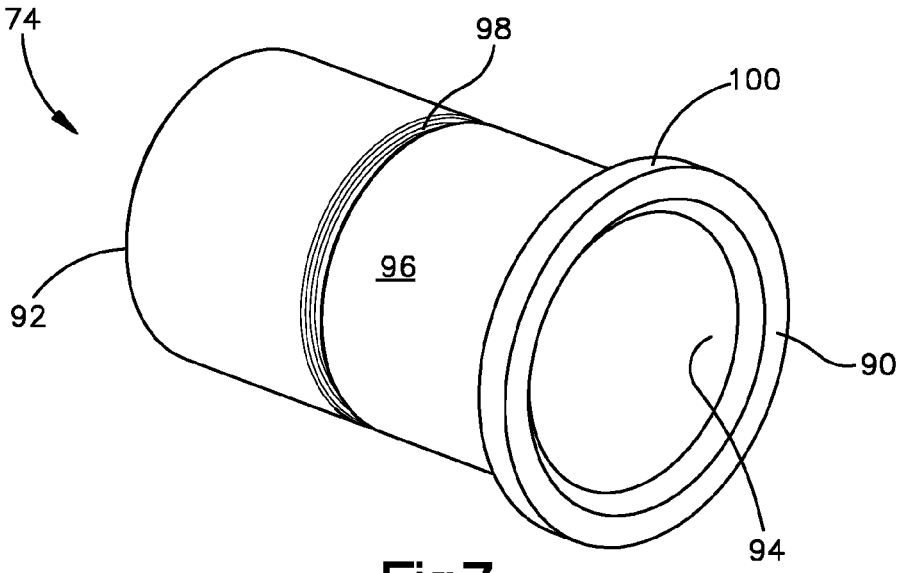
FIG. 7 is an isometric view of an adapter suitable for use with the insert assembly of FIG. 5.
Figure 8:
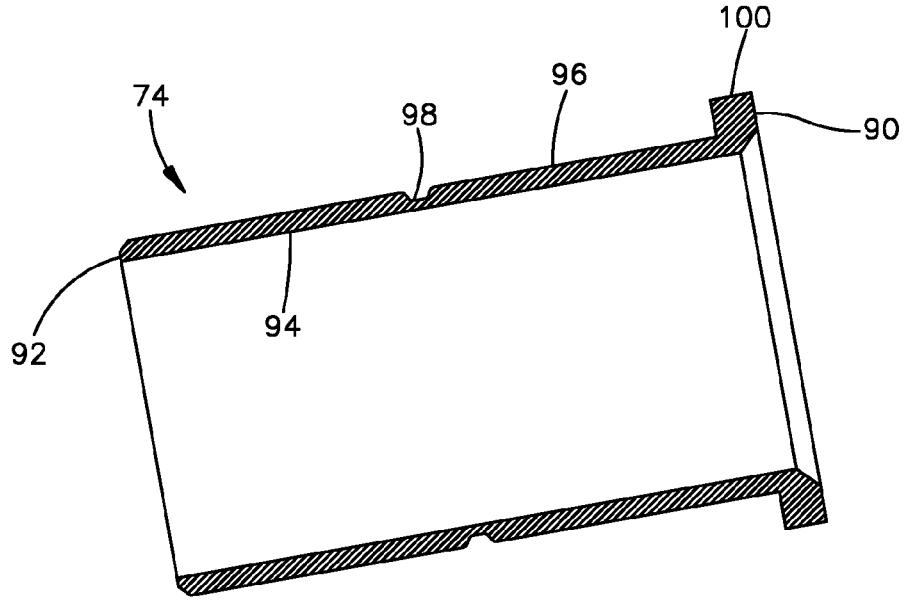
FIG. 8 is a cross-sectional view of the adapter of FIG. 7.

Referring now to FIGS. 4-6, the grinding fixture 10 further includes an insert assembly 70. The insert assembly 70 is disposed in the central bore 62 of the inner bearing race 46 of the housing assembly 30. In the depicted embodiment, the insert assembly 70 is adapted to receive the end portion 14 of the hose 16. The insert assembly 70 includes an insert housing 72 and an adapter 74 disposed in the insert housing 72.

The insert housing 72 is generally cylindrical in shape and has an outer diameter that is configured for receipt in the central bore 62 of the inner bearing race 46 of the housing assembly 30. In the depicted embodiment of FIG. 4, the insert housing 72 is secured in the central bore 62 of the inner bearing race 46 by a fastener 76. In the depicted embodiment, the fastener 76 is a set screw that is in threaded engagement with the inner bearing race 46.

The insert housing 72 includes a first end 78 and an oppositely disposed second end 80. The insert housing 72 defines a central longitudinal axis 82 that extends through the center of the first end 78 and the center of the second end 80. In the depicted embodiment, the central longitudinal axis 82 of the insert housing 72 is generally perpendicular to the grinder 12. In another embodiment, the central longitudinal axis 82 of the insert housing 72 is generally parallel to the mounting surface 40 of the grinding fixture 10.

The insert housing 72 defines a thru-hole 84 that extends through the first and second ends 78, 80 of the insert housing 72. The thru-hole 84 has a central axis 86. In depicted embodiment, the thru-hole 84 extends through the insert housing 72 at an oblique angle $\alpha$. The angle $\alpha$ of the thru-hole 84 is the angle between the central axis 86 of the bore and the central longitudinal axis 82 of the insert housing 72. In one embodiment, the angle $\alpha$ of the thru-hole 84 is less than or equal to about 45 degrees. In another embodiment, the angle $\alpha$ of the thru-hole 84 is less than or equal to about 30 degrees. In another embodiment, the angle $\alpha$ of the thru-hole 84 is less than or equal to about 15 degrees. In another embodiment, the angle $\alpha$ of the thru-hole 84 is less than or equal to about 10 degrees. In another embodiment, the angle $\alpha$ of the thru-hole 84 is in a range of about 10 degrees to about 20 degrees.

The insert housing 72 includes a bearing 88 disposed in the thru-hole 84. In the depicted embodiment, the bearing 88 is a needle bearing. In another embodiment, the bearing 88 is a plain bearing. In another embodiment, the bearing 88 is a bushing. In the depicted embodiment, the insert housing 72 includes a first bearing 88*a* disposed in the thru-hole 84 adjacent the first end 78 and a second bearing 88*b* disposed in the thru-hole 84 adjacent the second end 80.

Referring now to FIGS. 4 and 6-8, the adapter 74 will be described. The adapter 74 includes a first axial end 90 and an oppositely disposed second axial end 92. The adapter 74 defines a central opening 94 that extends through the first and second axial ends 90, 92.

An outer surface 96 of the adapter 74 defines a groove 98 between the first and second axial ends 90, 92. The groove 98 extends circumferentially around the outer surface 96.

The adapter 74 further includes a flange 100. The flange 100 extends radially outward from the first axial end 90 of the adapter 74.

Referring now to FIG. 6, the insert assembly 70 further includes a detent assembly 102 disposed in a hole 104 in the insert housing 72 that extends through an exterior surface 106 of the insert housing 72 and into the thru-hole 84 of the insert housing 72. The detent assembly 102 includes a detent housing 108, a detent 110 and a spring 112.

The detent housing 108 defines a cavity 114. The detent 110 and the spring 112 are disposed in the cavity 114.

In the depicted embodiment, the detent housing 108 is in threaded engagement with the hole 104 in the insert housing 74. When the adapter 74 is disposed in the thru-hole 84 of the insert housing 72, the detent 110 is aligned with the groove 98 of the adapter 74 so that a portion of the detent 110 is disposed in the groove 98 of adapter to prevent inadvertent removal of the adapter 74. The spring 112 has a spring force that allows for removal of the adapter 74 from the thru-hole 84 of the insert housing 72 when a removal force is applied to the adapter 74. When the removal force is applied to the adapter 74, the groove 98 acts on the detent 110 to compress the spring 112 so that the detent 110 moves into the cavity 114 of the detent housing 108 allowing the adapter 74 to be removed.

Referring now to FIGS. 5 and 6, the insert assembly 70 further includes a ring 116 mounted to the first end 78 of the insert housing 72. The ring 116 includes an inner surface 118 and an outer surface 120. The inner surface 118 defines a central opening that is sized to receive the first end 78 of the insert housing 72. In the depicted embodiment, the outer surface 120 of the ring 116 includes a plurality of external teeth 122. The external teeth 122 are adapted for engagement with a timing belt (not shown).

In the depicted embodiment, the ring 116 is mounted to the insert housing 72 by a plurality of fasteners. The fasteners extend through the outer and inner surfaces 120, 118 in a radial direction. In the depicted embodiment, the fasteners are in threaded engagement with the insert housing 72.

In the depicted embodiment, the insert assembly 70 further includes a belt retainer 124. The belt retainer 124 is mounted to the ring 116 and is adapted to prevent the timing belt from moving axially toward the first end 78 of the insert housing 72. The belt retainer 124 has an outer diameter that is greater than an outer diameter of the ring 116.

Referring now to FIG. 1, the grinding fixture assembly 8 includes the motor assembly 11. In the depicted embodiment, the motor assembly 11 includes an electric motor 128 and a pulley 130. The pulley 130 is engaged to an output shaft of the electric motor 128. The pulley 130 includes a plurality of external teeth 132. In the depicted embodiment, the pulley 130 has an outer diameter that is less than an outer diameter of the ring 116. The pulley 130 is adapted to receive the timing belt (not shown). The pulley 130 is generally aligned in an axial direction with the ring 116 of the insert assembly 70. The timing belt is disposed around a portion of the pulley 130 and a portion of the ring 116 so that it provides for rotation of the insert assembly 70 in response to rotation of the output shaft of the electric motor 128.

Figure 9:
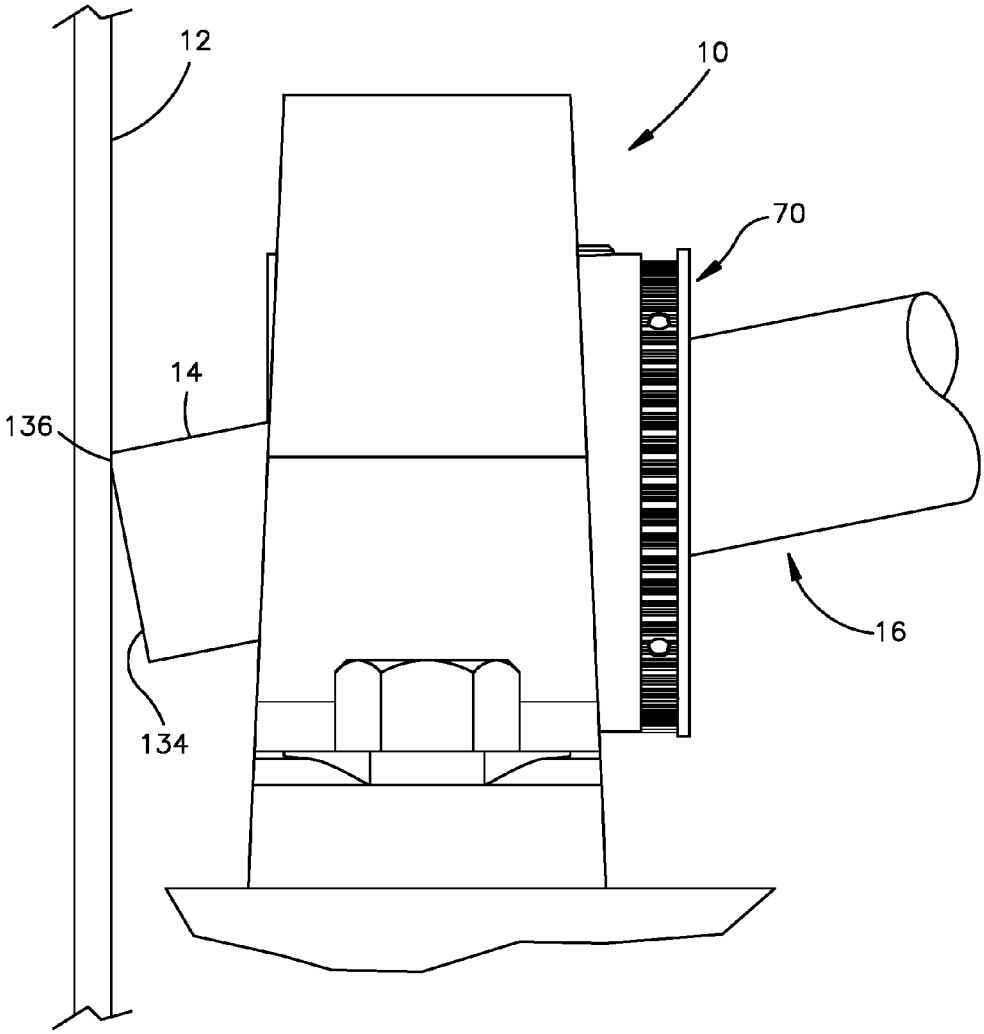
FIG. 9 is a side view of the grinding fixture with an end portion of a hose disposed in the grinding fixture.
Figure 10C:
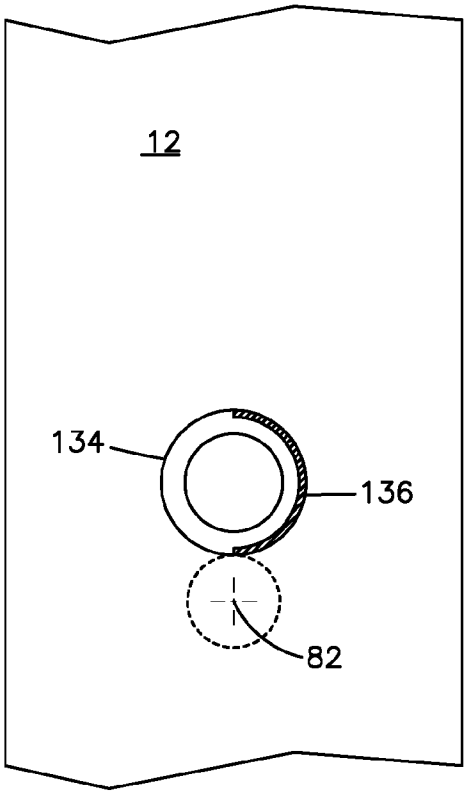
Figure 10B:
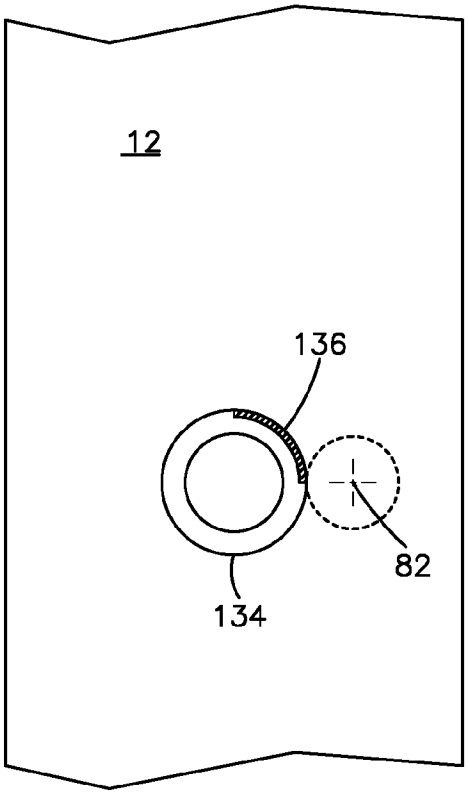
Figure 10A:
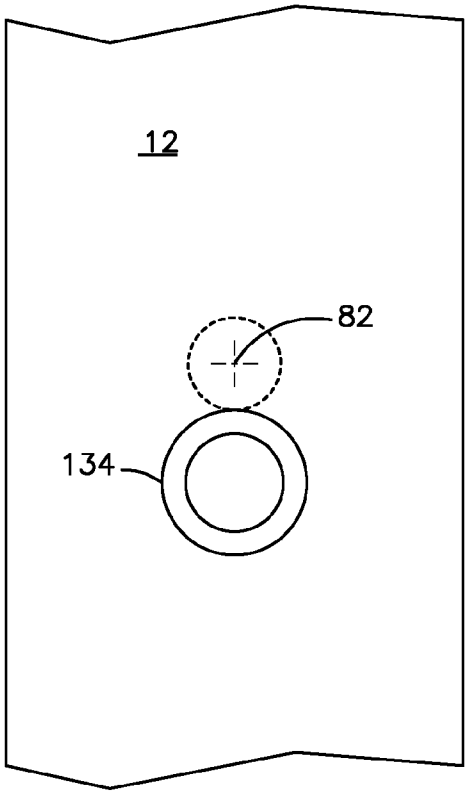
Figure 10E:
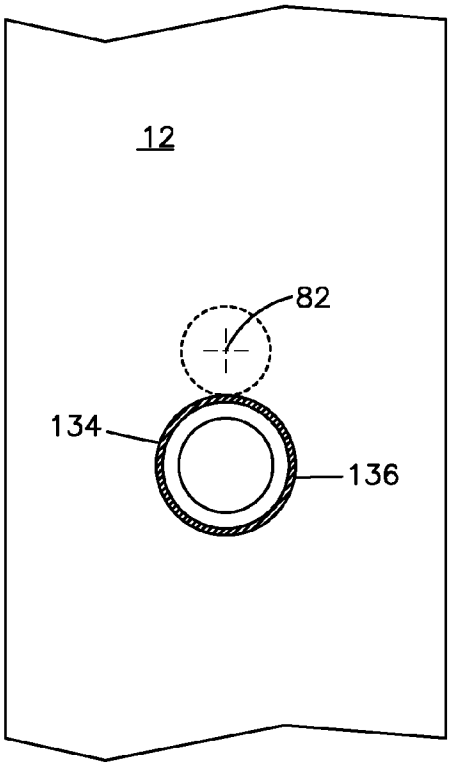
Figure 10D:
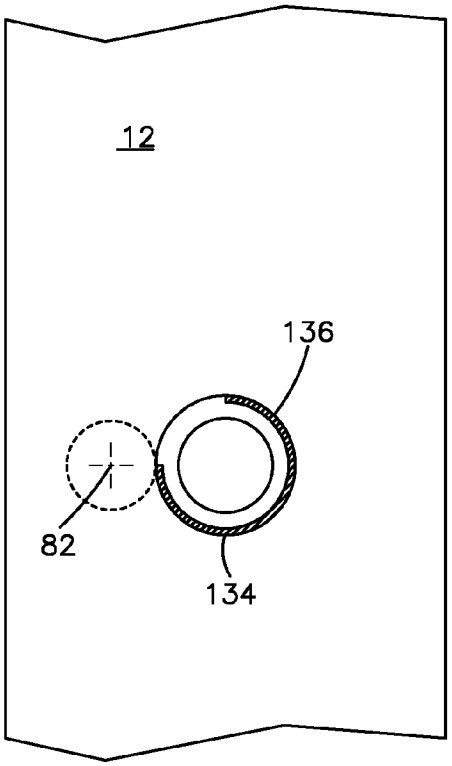

Referring now to FIGS. 6 and 9, a method for grinding an end surface 134 of the hose 16 using the grinding fixture 10 will be described. The end portion 14 of the hose 16 is inserted in the central opening 94 of the adapter 74 of the insert assembly 70 until the end surface 134 of the hose 16 abuts the grinder 12. Since the adapter 74 is disposed in the thru-hole 84, which is disposed at the oblique angle $\alpha$, only a portion 136 of the end surface 134 contacts the grinder 12.

With the end portion 14 of the hose 16 disposed in the central opening 94 of the adapter 74, the insert housing 72 is rotated about the central longitudinal axis 82 of the insert housing 72. In the depicted embodiment, the motor assembly 11 rotates the insert housing 72 through the timing belt. In another embodiment, the insert housing 72 is rotated manually.

As the insert housing 72 is rotated, the end portion 14 of the hose 16 is held rotationally stationary about a central longitudinal axis 138 of the hose 16 in the thru-hole 84 of the adapter 74. Keeping the hose 16 rotationally stationary about its central longitudinal axis 138 is advantageous especially for long lengths of hose 16 as it prevents twisting of the hose 16.

Referring now to FIGS. 9 and 10*a-e*, as the insert housing 72 is rotated, the end surface 134, while remaining rotationally stationary about its central longitudinal axis 138, orbits around the central longitudinal axis 82 of the insert housing 72. As the end surface 134 orbits around the central longitudinal axis 82 of the insert housing 72, the portion 136 of the end surface 134 that is in contact with the grinder 12 moves about an outer circumference of the end surface 134. After one complete orbit, the outer circumference of the end surface 134 has been in contact with the grinder 12. The end surface 134 is ground by the grinder 12 until a desired amount of grinding has been achieved. In the depicted embodiment, the end surface 134 is ground until the first and second conductive layers 20, 24 are no longer making contact. After the desired amount of grinding has been completed, the end portion 14 of the hose 16 is removed from the thru-hole 84 of the adapter 74 of the grinding fixture 10.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A grinding fixture assembly for use in grinding an end surface of a hose, the grinding fixture assembly comprising:
- a housing;
- a bearing assembly disposed in the housing, the bearing assembly defining a central bore;
- an insert assembly disposed in the central bore of the bearing assembly, the insert assembly including:
  - an insert housing defining a thru-hole that extends through the insert housing, the thru-hole being disposed at an oblique angle in the insert housing;
  - an adapter disposed in the thru-hole of the insert housing, the adapter defining a bore that is adapted to receive an end portion of a hose; and
  - a bearing disposed between the insert housing and the adapter, wherein the bearing allows for rotation of the insert housing while the adapter is maintained rotationally stationary.

2. The grinding fixture assembly of claim 1, wherein the bearing is a needle bearing.

3. The grinding fixture assembly of claim 1, wherein the insert assembly includes a ring mounted to a first end of the insert housing.

4. The grinding fixture assembly of claim 3, wherein the ring includes a plurality of external teeth.

5. The grinding fixture assembly of claim 1, further comprising a motor disposed adjacent to the housing, wherein the motor is configured to rotate the insert housing.

6. The grinding fixture assembly of claim 5, wherein a timing belt connects the motor to the insert housing.

7. The grinding fixture assembly of claim 1, wherein the adapter is removably disposed in the insert housing.

8. The grinding fixture assembly of claim 7, wherein a detent assembly is disposed in the insert housing, the detent assembly being adapted to retain the adapter in the thru-hole of the insert housing.

9. The grinding fixture assembly of claim 1, wherein the oblique angle is measure between the central longitudinal axis of the insert housing and the central axis of the thru-hole, the oblique angle being less than or equal to about 15 degrees.

10. A grinding fixture assembly for use in grinding a surface of a part, the grinding fixture assembly comprising:

a housing;

a bearing assembly disposed in the housing, the bearing assembly defining a central bore;

an insert assembly disposed in the central bore of the bearing assembly, the insert assembly including:

an insert housing defining a central longitudinal axis and a thru-hole that extends through the insert housing, the thru-hole being disposed at an oblique angle to the central longitudinal axis;

an adapter disposed in the thru-hole of the insert housing, the adapter defining a bore that is adapted to receive a portion of a part; and a bearing disposed between the insert housing and the adapter, wherein the bearing allows for rotation of the insert housing while the adapter is maintained rotationally stationary so that the surface of the part orbits about the central longitudinal axis of the insert housing.

11. The grinding fixture assembly of claim 10, wherein the part is a hose.

12. The grinding fixture assembly of claim 10, wherein the oblique angle is less than or equal to about 15 degrees.

13. The grinding fixture assembly of claim 10, further comprising a motor disposed adjacent to the housing, wherein the motor is configured to rotate the insert housing.

14. A method for grinding an end surface of a hose, the method comprising:

inserting an end portion of a hose into a bore of an adapter of a grinding fixture, wherein the adapter is disposed in a thru-hole of an insert housing with a bearing disposed between the insert housing and the adapter, the thru-hole being disposed at an oblique angle relative to a central longitudinal axis of the insert housing; and rotating the insert housing so that an end surface of the hose orbits about the central longitudinal axis of the insert housing while the end surface of the hose remains rotationally stationary about a central longitudinal axis of the hose.

15. The method of claim 14, wherein the oblique angle is less than or equal to about 15 degrees.

16. The method of claim 14, wherein the insert housing is disposed in a pillow block.

17. The method of claim 14, wherein a detent assembly is disposed in the insert housing, the detent assembly being adapted to retain the adapter in the thru-hole of the insert housing.

18. The method of claim 14, wherein a motor is disposed adjacent to the housing, the motor being configured to rotate the insert housing.

19. The method of claim 18, wherein a timing belt connects the motor to the insert housing.

20. The method of claim 14, wherein the bearing is a needle bearing.

* * * * *